US007609233B2

(12) United States Patent
Yang et al.

(10) Patent No.: US 7,609,233 B2
(45) Date of Patent: Oct. 27, 2009

(54) PLASMA DISPLAY DEVICE AND DRIVING APPARATUS THEREOF

(75) Inventors: Jin-Ho Yang, Suwon-si (KR); Woo-Joon Chung, Suwon-si (KR); Seong-Joon Jeong, Suwon-si (KR); Tae-Seong Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 623 days.

(21) Appl. No.: 11/346,922

(22) Filed: Feb. 2, 2006

(65) Prior Publication Data

US 2006/0267877 A1 Nov. 30, 2006

(30) Foreign Application Priority Data

May 25, 2005 (KR) ..... 10-2005-0044014

(51) Int. Cl.
*G09G 3/28* (2006.01)

(52) U.S. Cl. ..... 345/60; 345/67

(58) Field of Classification Search ..... 345/37, 345/39, 42, 44, 46, 60–69, 204, 208–214; 315/169.3, 169.4
See application file for complete search history.

(56) References Cited

U.S. PATENT DOCUMENTS 6,160,531 A * 12/2000 Chen et al. ..... 345/60
2003/0071578 A1* 4/2003 Lee et al. ..... 315/169.3
2004/0070350 A1 4/2004 Kwak et al.

FOREIGN PATENT DOCUMENTS

| | | |
|---|---|---|
| EP | 1 398 755 A2 | 3/2004 |
| EP | 1 498 868 A2 | 1/2005 |
| JP | 08-160901 | 6/1996 |
| JP | 11-352927 | 12/1999 |
| JP | 2001-337640 | 12/2001 |
| JP | 2003-140602 | 5/2003 |
| JP | 2004-029817 | 1/2004 |
| JP | 2004-046160 | 2/2004 |
| JP | 2005-115390 | 4/2005 |
| JP | 2006-284721 | 10/2006 |

* cited by examiner

*Primary Examiner*—Richard Hjerpe
*Assistant Examiner*—Mansour M Said
(74) *Attorney, Agent, or Firm*—Christie, Parker & Hale, LLP

(57) ABSTRACT

A sustain or scan electrode driver for a plasma display device including a power recovery circuit, a voltage storage circuit, and a switching circuit. Power recovery is achieved by a coupling a power source at a minus sustain voltage to the sustain or scan electrode driver circuit that includes a capacitor and an inductor for creating resonance with the panel capacitor and recovering the power used in sustain discharge. Power loss of switches used in the driver circuit may be reduced and power recovery efficiency may be increased by using an additional capacitor in the driver circuit that maintains terminals of the switch at a predetermined level.

14 Claims, 9 Drawing Sheets

PLASMA DISPLAY DEVICE AND DRIVING APPARATUS THEREOF

CROSS-REFERENCE TO RELATED APPLICATION

This application claims priority to and the benefit of Korean Patent Application No. 10-2005-0044014 filed in the Korean Intellectual Property Office on May 25, 2005, the entire contents of which are incorporated herein by reference.

BACKGROUND OF THE INVENTION

1. Field of the Invention

The present invention relates to a plasma display device including a plasma display panel (PDP), and a driving method for the PDP.

2. Description of the Related Art

A plasma display device is a flat panel display that uses plasma generated by a gas discharge process to display characters or images. It includes, depending on its size, more than several hundreds of thousands to millions of pixels arranged in a matrix pattern.

Generally, a driving method of the plasma display device may be expressed as operational changes according to time, which include a reset period, an address period, and a sustain period.

The reset period is for initializing the status of each discharge cell to facilitate an addressing operation on the discharge cell. The address period is for selecting turn-on/turn-off cells (i.e., discharge cells to be turned on or off) and accumulating wall charges in the turn-on cells (i.e., addressed discharge cells). The sustain period is for causing a discharge for displaying an image on the addressed cells.

In a driver of the plasma display device, displacement currents corresponding to a reactive power flow to respective discharge cells when sustain pulses are applied, and a sustain discharge is performed because discharge currents flow to the respective discharge cells when a sum of a wall voltage and an external voltage exceeds a discharge firing voltage. The sustain discharge is formed when a predetermined voltage is applied and predetermined discharge conditions are provided to the discharge cell. When the predetermined discharge conditions are not provided to the discharge cell, no discharge current flows, but the displacement currents flow to the discharge cell. The amount of the displacement currents is varied according to capacitance of a panel capacitor Cp, whose capacitance varies according to respective pixel types and elements. This type of driver has high power consumption. Because the panel capacitor consumes considerable reactive power, an energy regenerating circuit in a driving circuit is needed to reduce the consumption of the reactive power.

Known power recovery circuits include a circuit for using a power source of a ½ Vs voltage, where Vs denotes the amplitude of the sustain pulse. These circuits apply a sustain pulse having a voltage variation range between +½ Vs and −½ Vs. By using such a circuit, switches enduring a voltage of ½ Vs may be used.

In such known circuits, however, the number of switching operations for forming one sustain pulse may be greatly increased and a hard switching method may be adopted. When an energy regenerating circuit for a soft switching operation is provided, the number of the switching operations may be further increased, and the switching sequence becomes further complicated.

Accordingly, in the PDP drivers disclosed in the prior art, it is not easy to change the output voltage range, and manufacturing cost is increased because elements capable of enduring a high voltage need to be used.

The above information disclosed in this Background section is only for enhancement of understanding of the background of the invention and therefore it may contain information that does not form the prior art that is already known in this country to a person of ordinary skill in the art.

SUMMARY OF THE INVENTION

Embodiments of the present invention provide a plasma display device for easily varying output voltage range of a driving circuit for the device and having low voltage elements, and a method of driving the plasma display device.

An exemplary plasma display device according to an embodiment of the present invention includes a plurality of the first electrodes, a first switch, a first diode, a second switch, a second diode, at least one inductor, a first capacitor, a third switch, a fourth switch, a second capacitor, and a third diode. The first switch has a first terminal electrically coupled to a first power source supplying a first voltage. The first diode has a cathode coupled to a second terminal of the first switch. The second switch has a first terminal electrically coupled to the first power source. The second diode has an anode coupled to a second terminal of the second switch. The at least one inductor has a first terminal electrically coupled to an anode of the first diode and a cathode of the second diode, and has a second terminal electrically coupled to the first electrode. The first capacitor has a first terminal coupled to the second terminal of the second switch. The third switch has a first terminal electrically coupled to a second terminal of the first capacitor, and has a second terminal coupled to the first electrode. The fourth switch has a first terminal coupled to a second power source supplying a second voltage less than the first voltage, and has a second terminal electrically coupled to the first electrode. The second capacitor has a first terminal coupled to the first terminal of the third switch, and has a second terminal coupled to a third power source supplying a third voltage. The third diode has an anode coupled to the second terminal of the first switch, and has a cathode coupled to the second terminal of the first capacitor.

An exemplary driver of a plasma display device according to an embodiment of the present invention, the driver applying a voltage to a plurality of the first electrodes includes a first switch, a second switch, at least one inductor, a voltage falling path, a voltage rising path, a first capacitor, a third switch, a fourth switch, a second capacitor, and a charging path. The first switch has a first terminal electrically coupled to a first power source supplying a first voltage. The second switch has a first terminal electrically coupled to the first power source. The at least one inductor has a first terminal electrically coupled to the first electrode. The voltage falling path reduces a voltage at the first electrode when the first switch is turned on, and is coupled between a second terminal of the first switch and a second terminal of the inductor. The voltage rising path increases the voltage at the first electrode when the second switch is turned on, and is coupled between a second terminal of the second switch and the second terminal of the inductor. The first capacitor has a first terminal coupled to the second terminal of the second switch. The third switch has a first terminal electrically coupled to a second terminal of the first capacitor, and has a second terminal electrically coupled to the first electrode. The fourth switch has a first terminal coupled to a second power source supplying a second voltage less than the first voltage, and has a second terminal electrically coupled to the first electrode. The second capacitor has a first terminal coupled to the first terminal of the third switch, and has a second terminal coupled to a third power source supplying a third voltage. The charging path charges the first capacitor, and is formed by electrically coupling the second terminal of the first capacitor to the first power source and electrically coupling the first terminal of the first capacitor to the second power source.

DETAILED DESCRIPTION OF THE EMBODIMENTS

Figure 1:
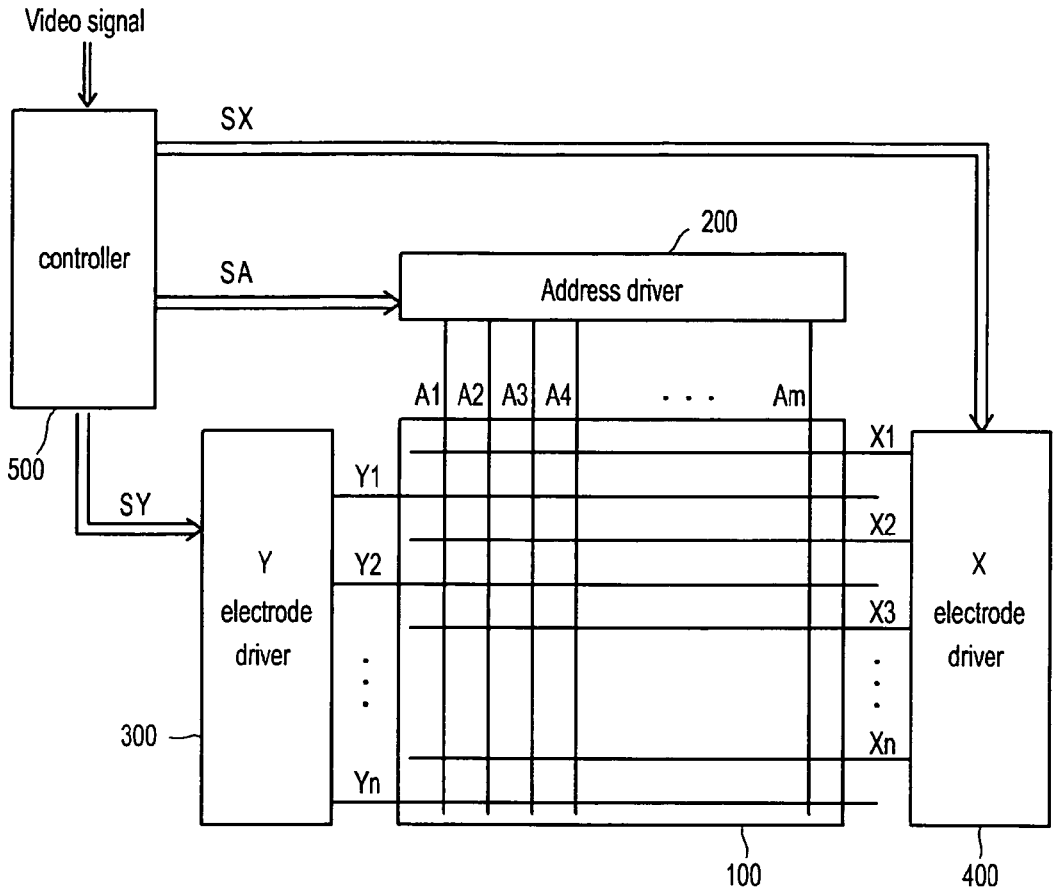
FIG. 1 shows a diagram representing a plasma display device according to an exemplary embodiment of the present invention.

FIG. 1 shows a diagram representing a plasma display device according to an exemplary embodiment of the present invention. The plasma display device includes a plasma display panel (PDP) 100, an address driver 200, a Y electrode driver 300, an X electrode driver 400, and a controller 500.

The PDP 100 includes a plurality of address electrodes A1-Am extending in the column direction, and first electrodes Y1-Yn (hereinafter, referred to as Y electrodes) and second electrodes X1-Xn (hereinafter, referred to as X electrodes) extending in the row direction.

The address driver 200 receives an address driving control signal $S_A$ from the controller 500, and applies a display data signal for selecting turn-on discharge cells (i.e., discharge cells to be turned on) to the address electrodes A1-Am. The Y electrode driver 300 and X electrode driver 400 respectively receive a Y electrode driving signal $S_Y$ and an X electrode driving signal $S_X$ from the controller 500, and apply them to the Y electrodes Y1-Yn and the X electrodes X1-Xn.

The controller 500, externally receiving video signals, generates the address driving control signal $S_A$, the Y electrode driving signal $S_Y$, and the X electrode driving signal $S_X$, and respectively applies them to the address driver 200, the Y electrode driver 300, and the X electrode driver 400.

An exemplary configuration and operation of the Y electrode driver 300 will now be described with reference to FIG. 2 and FIG. 3.

Figure 2:
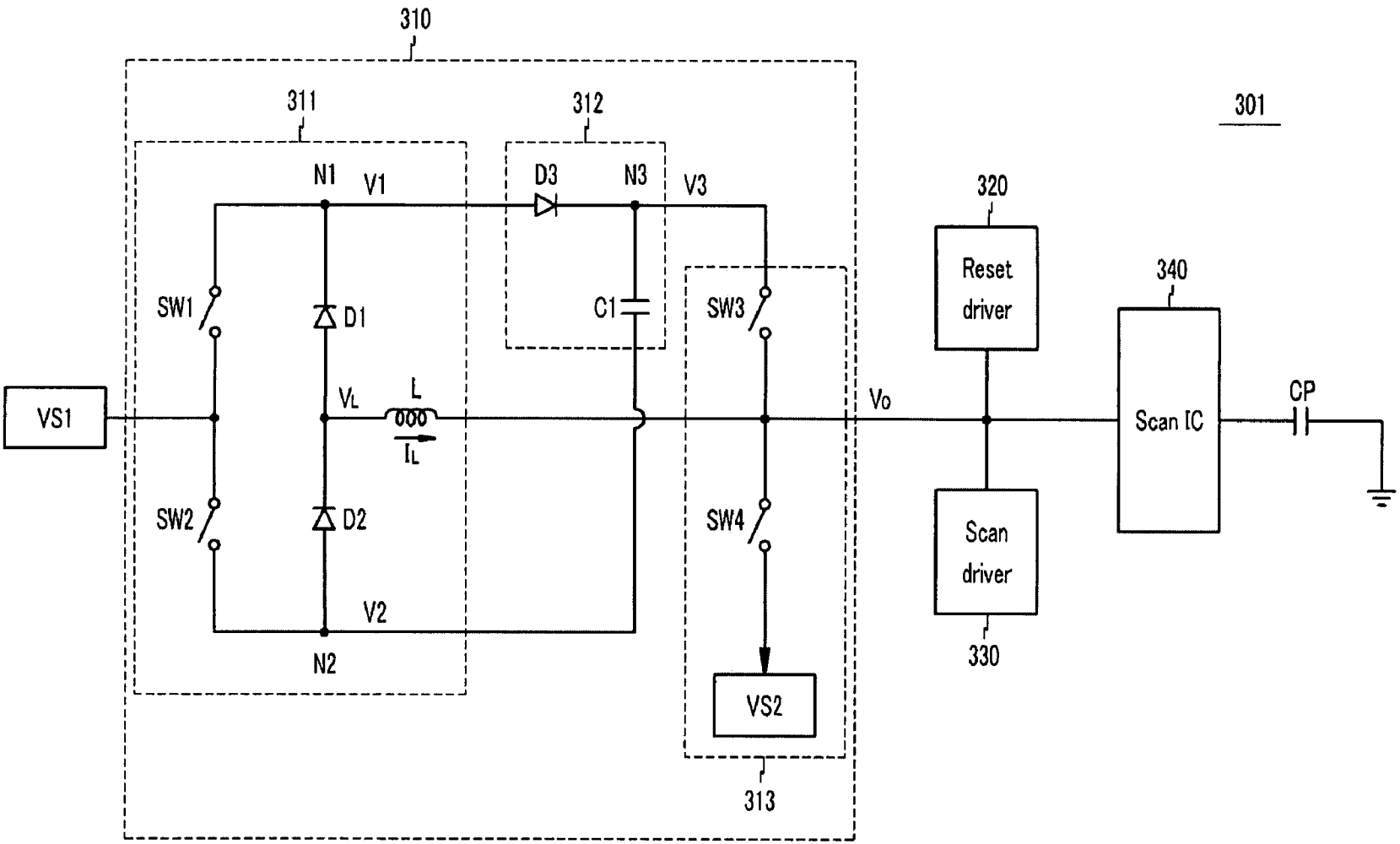
FIG. 2 show a circuit diagram of a Y electrode driver according to a first exemplary embodiment of the present invention.

FIG. 2 shows a circuit diagram of a Y electrode driver 301 according to a first exemplary embodiment of the present invention. The Y electrode driver 301 according to the first exemplary embodiment of the present invention includes a reset driver 320, a scan driver 330, a scan IC 340, and a sustain driver 310.

The reset driver 320 applies a voltage, i.e., the voltage gradually increasing or falling, to the Y electrode during a reset period. The scan driver 330 applies a scan signal to the Y electrode during an address period. The scan IC 340 includes a plurality of selection circuits and selects the Y electrode to which the scan signal is applied by the selection circuits.

The sustain driver 310 including a power recovery unit 311, a voltage storage unit 312, and a switching unit 313 supplies a voltage for performing the sustain discharge to the Y electrode during a sustain period. The sustain driver 310 also supplies a pair of external direct power sources VS1 and VS2 and the voltage stored in the voltage storage unit 312 to a panel capacitor Cp by a switching operation of the switching unit 313.

In more detail, the power recovery unit 311 includes an inductor L having a first terminal coupled to an output terminal for outputting a voltage Vo, a diode D1 having an anode coupled to a second terminal of the inductor L, a diode D2 having a cathode coupled to the second terminal of the inductor L, a switch SW1 having a first terminal coupled to a cathode of the diode D1, and a switch SW2 having a first terminal coupled to an anode of the diode D2. The switches SW1 and SW2 are coupled to each other in series forming a node that is coupled to the power source VS1. A first node N1 is formed between the diode D1 and the switch SW1, and a second node N2 is formed between the diode D2 and the switch SW2. A voltage between the first node N1 and the second node N2 is adjusted by switching operations of the switch SW1 and the switch SW2.

The voltage storage unit 312 includes a diode D3 having an anode coupled to the first node N1, and a capacitor C1 coupled between the second node N2 and a third node N3 which is a cathode of the diode D3. The capacitor C1 stores the voltage between the first and second nodes N1 and N2, that is being adjusted by the switching operation of the power recovery unit 311.

The switching unit 313 includes a switch SW3 coupled between the third node N3 and the output terminal Vo and a switch SW4 coupled between the output terminal Vo and a power source VS2. The switching unit 313 applies a voltage supplied from the power source VS2 or a voltage V3 at the third node to the panel capacitor Cp by switching operations of the switches SW3 and SW4.

The voltage supplied from the power source VS2 is set to be less than the voltage supplied from the power source VS1. For example, the voltage VS1 may be set to a ground voltage 0V and the voltage VS2 to a voltage −Vs. Accordingly, while the power recovery operation may be performed by using the voltages of 0V and −Vs, a pulse having a voltage of 2 Vs corresponding to double the amplitude of a difference between the voltage 0V and the voltage −Vs may be supplied to the panel capacitor Cp as the sustain pulse.

Hereinafter, an operation of the sustain driver 310 according to the first exemplary embodiment of the present invention will be described, based the power source VS2 supplying the voltage −Vs and the power source VS1 supplying the ground voltage 0V.

Figure 3:
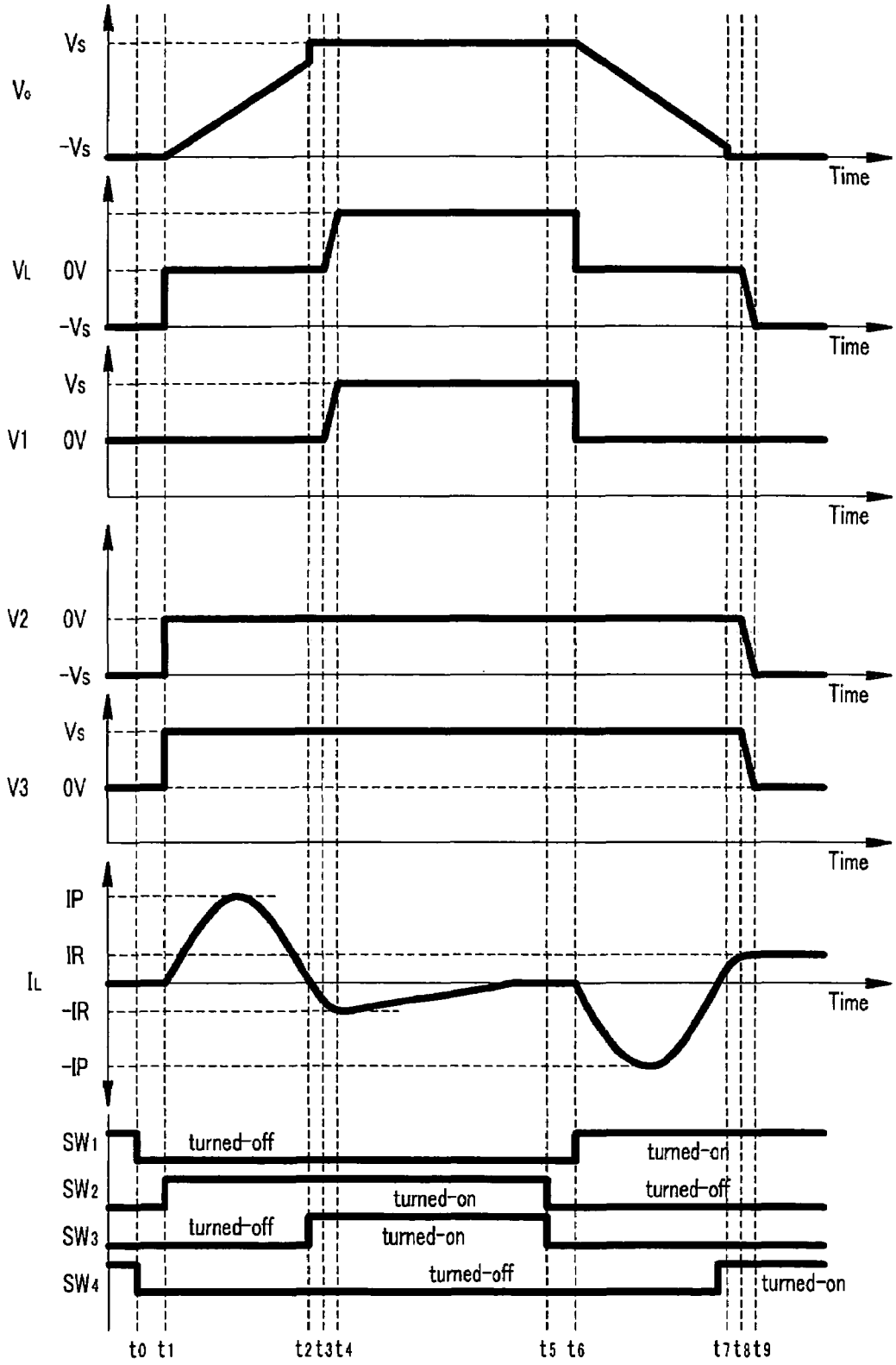
FIG. 3 shows switching timings and output voltage waveforms for driving the Y electrode driver according to the first exemplary embodiment of the present invention.

FIG. 3 shows switching timings for driving the sustain driver 310, voltage waveforms at various nodes, and current waveforms of the inductor L, according to a first exemplary embodiment of the present invention.

As shown in FIG. 3, at a time t0, the switches SW1 and SW4 are turned off and the switches SW2 and SW3 remain off. The output voltage Vo is maintained at the voltage −Vs because the voltage −Vs is applied to the panel capacitor Cp through the switch SW4 before this switch is turned off at t0.

Subsequently, when the switch SW2 is turned on at a time t1, a voltage V2 at the second node N2 and a voltage $V_L$ at a node between the diodes D1 and D2 are steeply increased to 0V, and accordingly, a serial inductor/capacitor (LC) resonance is generated between the inductor L and the panel capacitor Cp. Then, the output voltage Vo is gradually increased from the voltage −Vs to a voltage close to the voltage Vs. The output voltage Vo is increased only to a voltage close to the voltage Vs because an energy loss is caused by circuit impedance.

In addition, the voltage V3 at the third node N3 which is a voltage source of the switch SW3 is maintained at the voltage Vs because the voltage Vs is charged in the capacitor C1 and the voltage at the first terminal of the capacitor C1 is maintained at 0V by turning on the switch SW2 and coupling the node N2 to the power source VS1 that is 0V in this example.

A period between a time t2 and a time t3 corresponds to a reverse bias recovering time of the diode D2. The reverse bias recovering time will be referred to as a "time of reverse recovery (Trr)". That is, when the switch SW3 is turned on at the time t2, the output voltage V1 reaches the voltage Vs. In this case, a current $I_L$ of the inductor L is changed from a positive current to a negative current, and the diode D2 is changed from a forward bias state to a reverse bias state. However, the diode D2 may remain conducting for a predetermined initial part of the time of reverse recovery (Trr) according to characteristics of a PN-conjunction diode.

Subsequently, at the time t3, the second node N2 and the inductor L are short-circuited because the diode D2 is changed to the reverse bias state. Therefore, the voltage $V_L$ may not be maintained at 0V, but is increased by the current flowing through the inductor L. In this case, the voltage $V_L$ is increased to the voltage Vs while charging internal capacitance of the switch SW1, and conjunction capacitance of the internal diodes of this switch SW1.

When the voltage $V_L$ reaches the voltage Vs at a time t4, the diode D3 is changed to the forward bias state, and a freewheeling current flows through the switch SW3, the inductor L, the diode D1, and the diode D3. The freewheeling current is consumed by resistance of the freewheeling path, and is gradually reduced. The freewheeling current may be generated from the time t2 because a sustain discharge voltage is generated while the output voltage Vo is at the voltage Vs, when a voltage at the X electrode driver 400 shown in FIG. 1 is the voltage −Vs. In addition, a discharge current flows through the power source VS1, the switch SW2, the capacitor C1, and the switch SW3.

At a time t5, the switches SW2, SW3, and SW4 are turned off and the switch SW1 remains off. At the time t5, the output voltage Vo is maintained at the voltage Vs by the energy stored in the inductor L.

At a time t6 the switch SW1 is turned on. For a period between the time t6 and a time t7, the panel capacitor Cp is charged by storing the energy in the inductor L. That is, when the switch SW1 is turned on at the time t6, the voltage V1 at the first node N1 and the voltage $V_L$ at the first terminal of the inductor L are steeply reduced to 0V, a serial LC resonance is generated between the inductor L and the panel capacitor Cp, and the output voltage Vo is gradually decreased from the voltage Vs to the voltage −Vs. In this case, the power is recovered to the power source VS1 from the panel capacitor Cp through the inductor L.

A period between the time t7 and a time t8 is the time of reverse recovery Trr. That is, the output voltage Vo is reduced to the voltage −Vs by turning on the switch SW4 at the time t7. In this case, the current $I_L$ of the inductor L is changed from a negative current to a positive current, and the diode D1 is changed from the forward bias state to the reverse bias state.

When the diode D1 is changed to the reverse bias state, the voltage $V_L$ may not be maintained at 0V, but will be reduced to the voltage −Vs. In this case, the voltage $V_L$ is reduced while an internal capacitance of the switch SW2 and a conjunction capacitance of the internal diodes of this switch SW2 are also reduced.

When the voltage $V_L$ reaches the voltage −Vs at a time t9, the diode D2 is changed back to the forward bias state, and the current $I_L$ flowing through the inductor L is discharged and added to a current for recharging the voltage at the capacitor C1. That is, voltage is recharged to the capacitor C1 through the power source VS1, the switch SW1, the diode D3, the capacitor C1, the diode D2, the inductor L, the switch SW4, and the power source −Vs.

In this case, because the capacitor C1 has a larger capacitance than the panel capacitor Cp, resonance is not generated between the capacitor C1 and the inductor L, and the capacitor C1 functions as a low pass filter LPF. Accordingly, the current does not flow rapidly. When the sustain discharge is generated at the time t9, the switch SW4 covers the discharge current.

The sustain pulse swinging between the voltage Vs and the voltage −Vs may be supplied to the panel capacitor Cp by repeatedly performing the above operations at times t0 to t9.

In addition, time for charging the capacitor C1 may be reduced when a path for charging the capacitor C1 is reduced. A circuit for reducing the path for charging the capacitor C1 will now be described.

Figure 4:
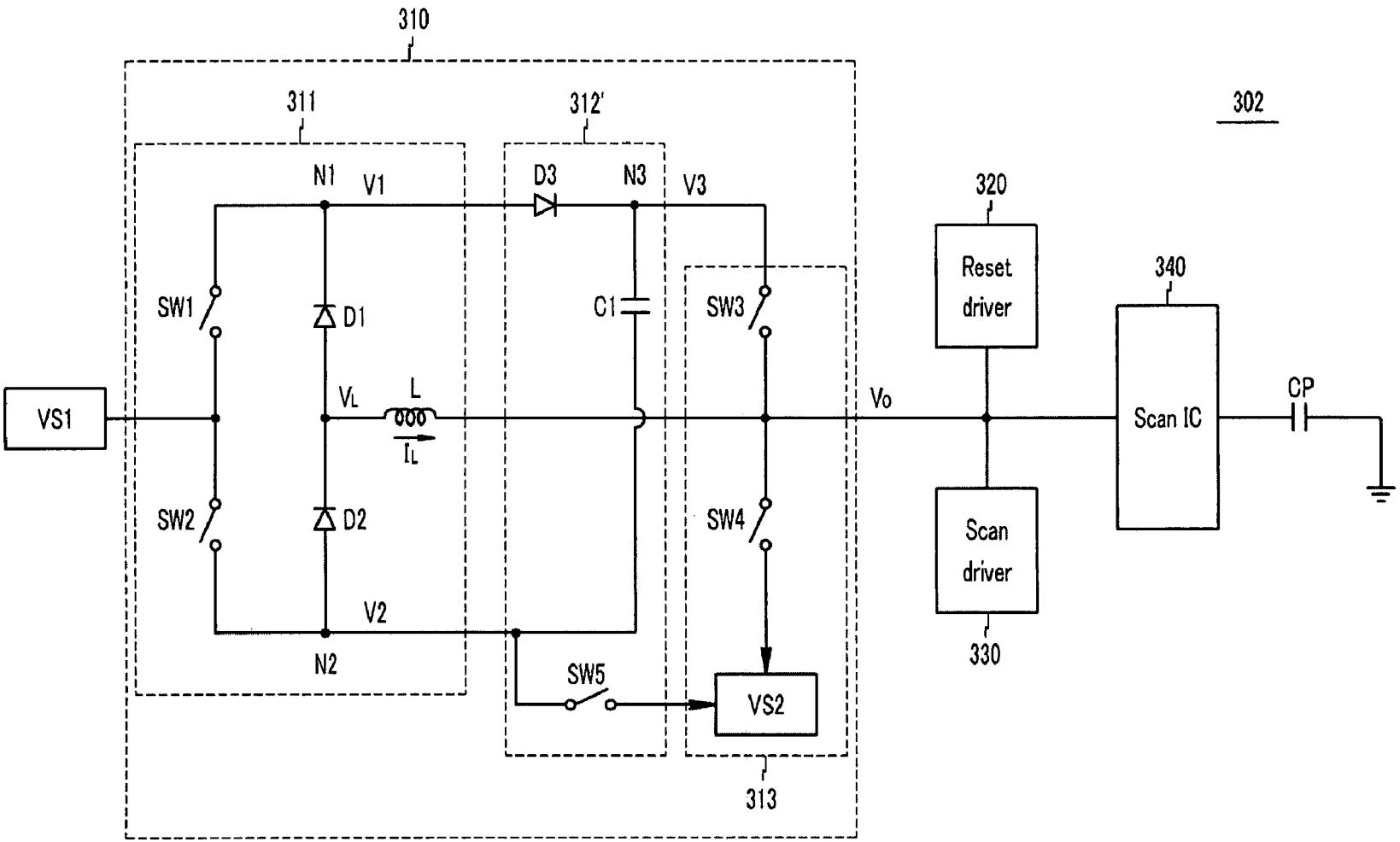
FIG. 4 shows a circuit diagram of the Y electrode driver according to a second exemplary embodiment of the present invention.
Figure 5:
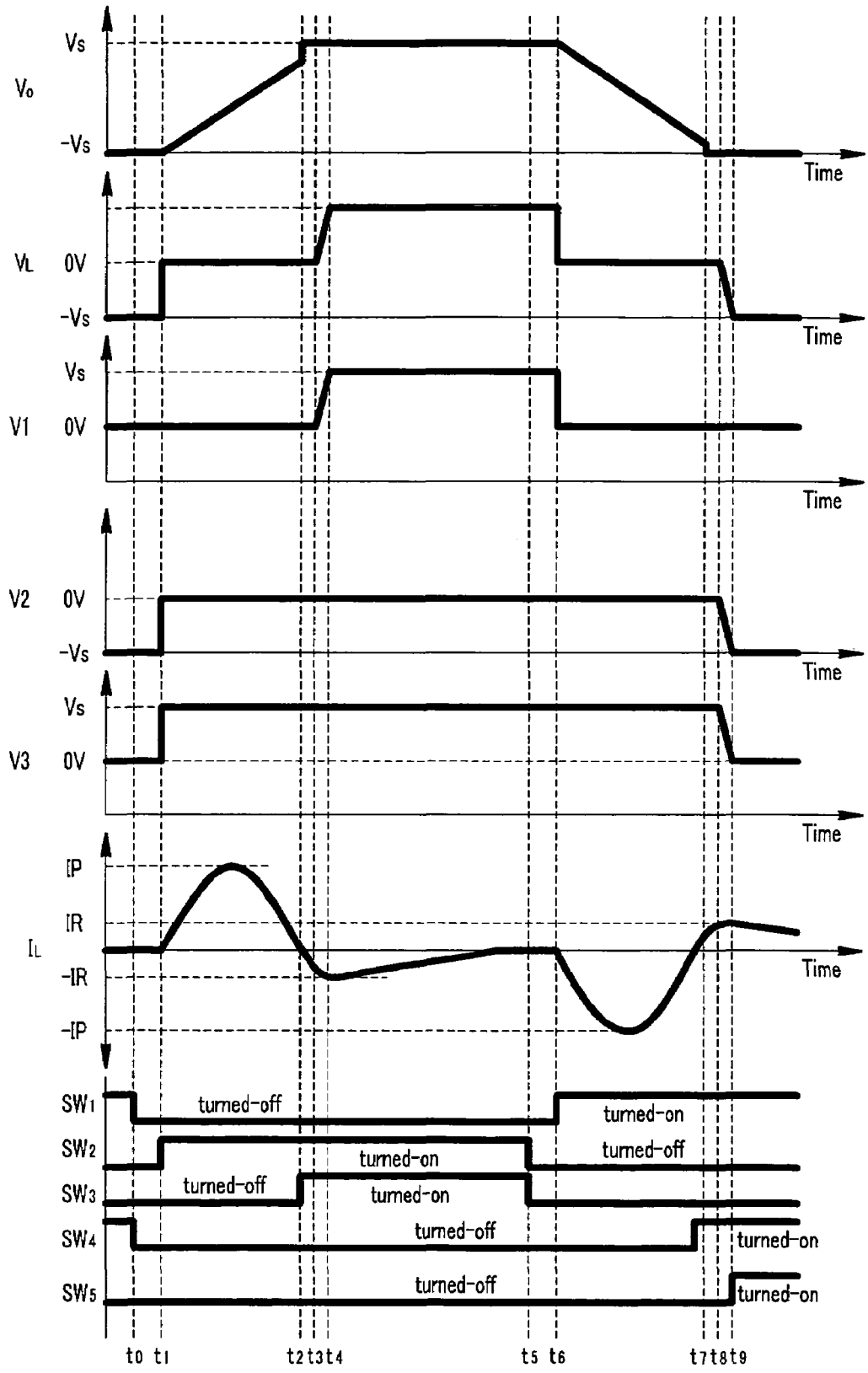
FIG. 5 show switching timings and output waveforms for driving the Y electrode driver according to the second exemplary embodiment of the present invention.
Figure 6:
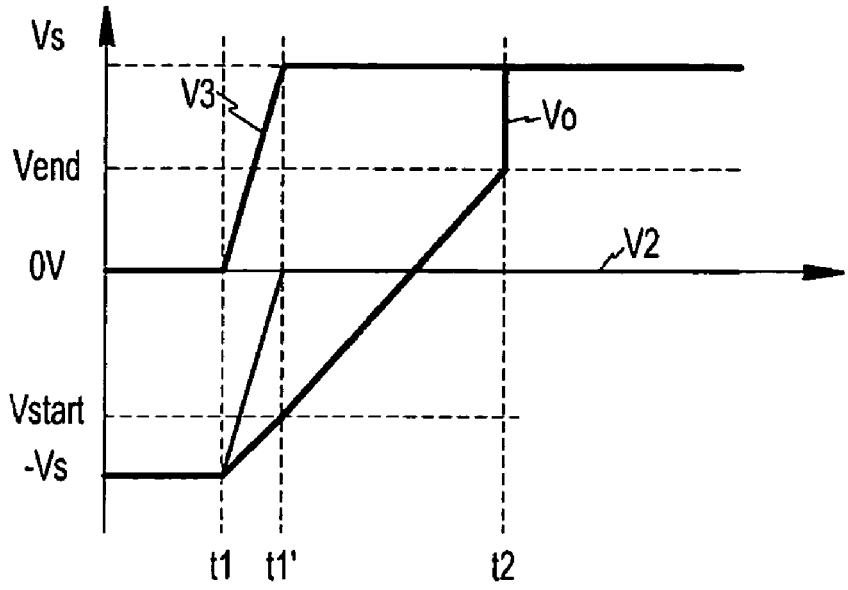
FIG. 6 shows a detailed diagram representing the output waveforms of the Y electrode driver according to the second exemplary embodiment of the present invention.

FIG. 4 shows a circuit diagram of the Y electrode driver 300 according to a second exemplary embodiment 302 of the present invention. FIG. 5 shows switching timings and output waveforms for driving the Y electrode driver 300 according to the second exemplary embodiment of the present invention. FIG. 6 shows a detailed diagram representing the output waveforms of the Y electrode driver 302 according to the second exemplary embodiment of the present invention.

As shown in FIG. 4, the Y electrode driver 302 according to the second exemplary embodiment of the present invention has the same configuration as the first exemplary embodiment of the present invention 301 except a configuration of the voltage storage unit 312', and accordingly, parts described above will be omitted.

In further detail, the voltage storage unit 312' according to the second exemplary embodiment of the present invention further includes a switch SW5 coupled between the second node N2 and the power source VS2.

As shown in FIG. 5, operations and output waveforms from the time t0 to the time t9 are the same as those according to the first exemplary embodiment of the present invention. That is, the switch SW5 is maintained off from the time t0 to the time t9, and it is turned on at the time t9. Then, the charging current path is formed through the power source VS1, the switch SW1, the diode D3, the capacitor C1, the switch SW5, and the power source VS2 that is at voltage −Vs.

Therefore, the charging current path of the capacitor C1 in the second exemplary embodiment omits the portions through the diode D2, the inductor L, the switch SW4, and the power source −VS2, that existed in the first exemplary embodiment. Accordingly, the charging path is reduced. Therefore, the capacitor C1 is quickly recharged to replenish the charges consumed by the previous discharge. In this case, as shown in FIG. 5, the current $I_L$ flowing through the inductor L is gradually reduced because the freewheeling current flows through the switch SW5, the diode D2, the inductor L, the switch SW4, and the power source VS2. As explained above, the power source VS2 may be at the voltage −Vs.

According to the first and second exemplary embodiments 301, 302 of the present invention, when the switch SW2 is turned on at the time t1, the voltage V2 at the second node N2 and the voltage $V_L$ are increased to 0V, and the voltage Vo is gradually increased by the resonance between the inductor L and the panel capacitor Cp. In addition, the voltage V1 is maintained at 0V by turning on the switch SW2 while the voltage Vs is charged to the capacitor C1 before the time t1, and therefore, the voltage V3 at the third node N3 is instantaneously increased to the voltage Vs before the resonance is started. The switch SW3 that remains off at t1 has a capacitance component Csw3. The capacitance component Csw3 is coupled to the panel capacitor Cp in series so that the voltages are distributed. The voltage Vo is increased as shown in following equation.

$$Vo=-Vs+Csw3/(Csw3+Cp)Vs$$

Specifically, when a metal-oxide semiconductor field-effect transistor (MOSFET) is used for the switch SW3, the voltage Vo is further increased when an additional capacitor is provided in parallel between the drain and source of the switch in order to reduce an electromagnetic interference (EMI) occurring by a switching operation.

Referring to FIG. 6, the switch SW2 is turned on at the time t1, and the voltage V2 at the second node is increased from the voltage −Vs to 0V and the voltage V3 at the third node is increased from 0V to the voltage Vs at a resonance starting time t1'. In addition, the output voltage Vo is increased from the voltage −Vs to a voltage Vstart by the capacitance component Csw3 of the switch SW3. That is, even assuming resonance efficiency of 100%, a voltage Vend (i.e., the voltage at a time when the resonance has ended) is equal to the voltage −Vstart and does not reach the voltage Vs because resonance started at the voltage Vstart that has a smaller absolute value than −Vs, or in other words is closer to 0V than the voltage −Vs. Therefore, power recovery efficiency is also reduced. In addition, power loss is increased when the switch SW2 is turned on, because the current for increasing the voltage V2 and the current for increasing the voltages V3 and Vo flow through the switch SW2 for a period between the time t1 and the time t2.

Accordingly, a circuit for increasing a voltage peak value and the power recovery efficiency after the resonance and reducing the power loss of the switch SW2 will be described.

Figure 7A:
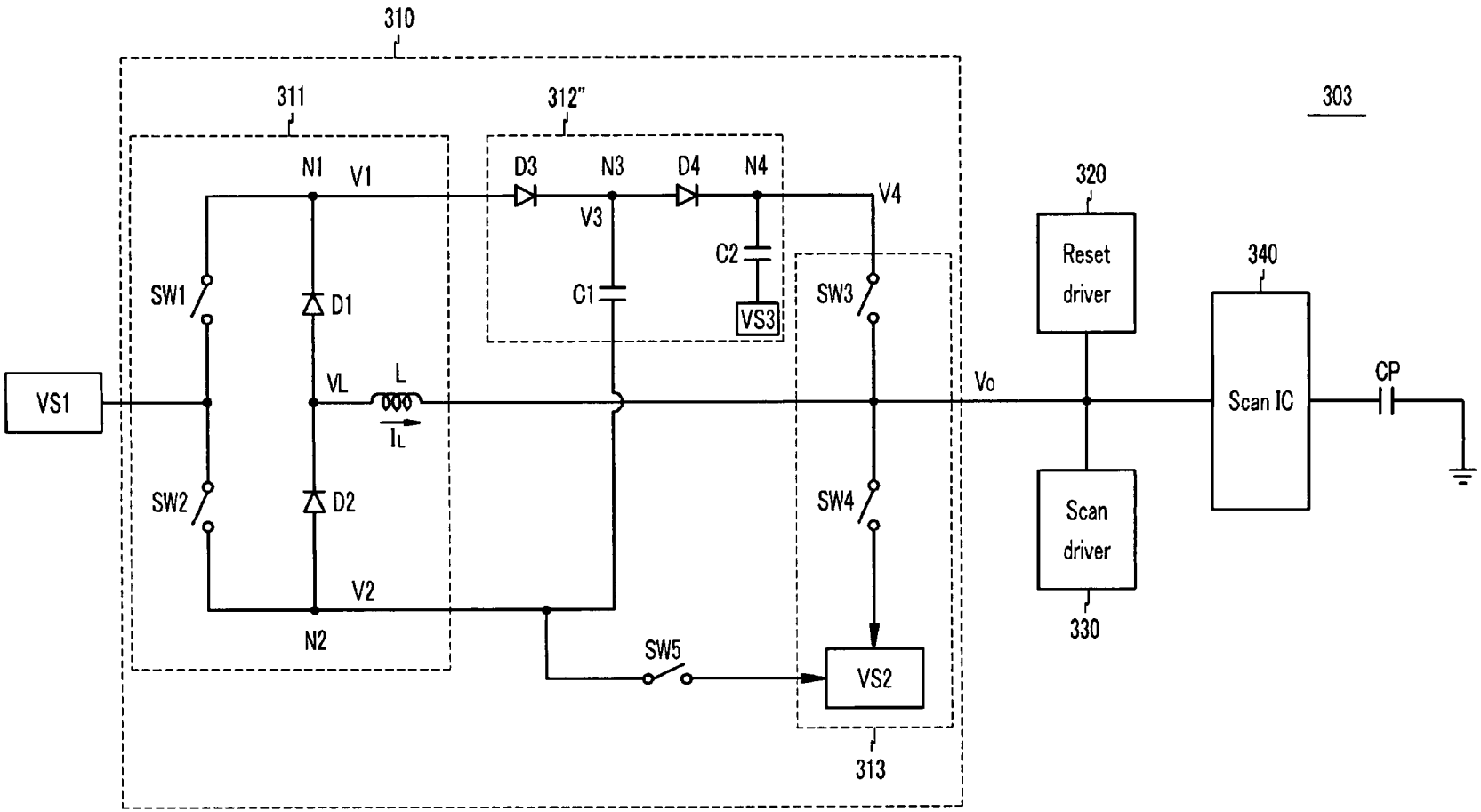
FIG. 7A shows a circuit diagram of the Y electrode driver according to a third exemplary embodiment of the present invention.
Figure 8:
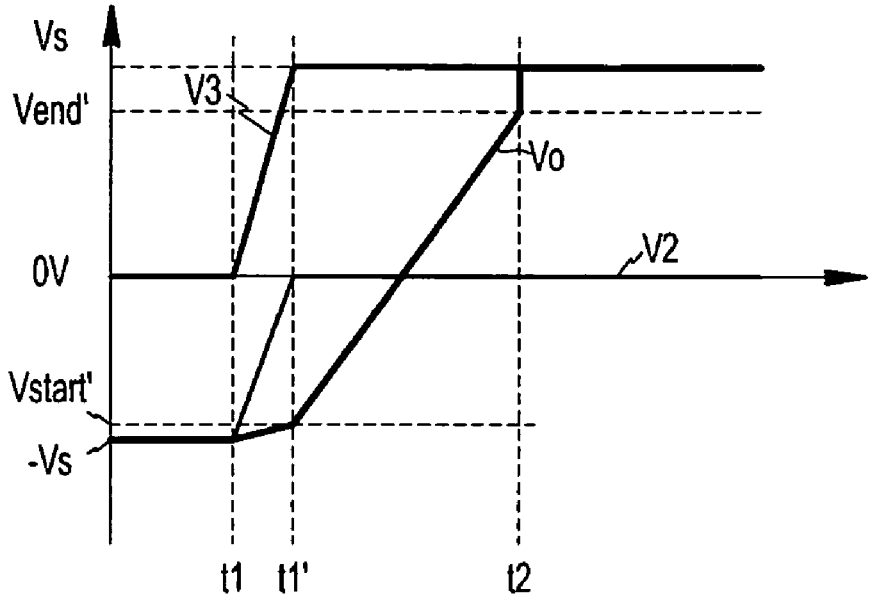
FIG. 8 shows output waveforms of the Y electrode driver according to the third exemplary embodiment of the present invention.

FIG. 7A shows a circuit diagram of the Y electrode driver 300 according to a third exemplary embodiment 303 of the present invention, and FIG. 8 shows output waveforms of the Y electrode driver according to the third exemplary embodiment of the present invention.

As shown in FIG. 7A, the Y electrode driver 303 according to the third exemplary embodiment of the present invention has the same configuration as that according to the second exemplary embodiment 302 of the present invention except the configuration of the voltage storage unit 312", and accordingly, parts having described above will be omitted.

Figure 7B:
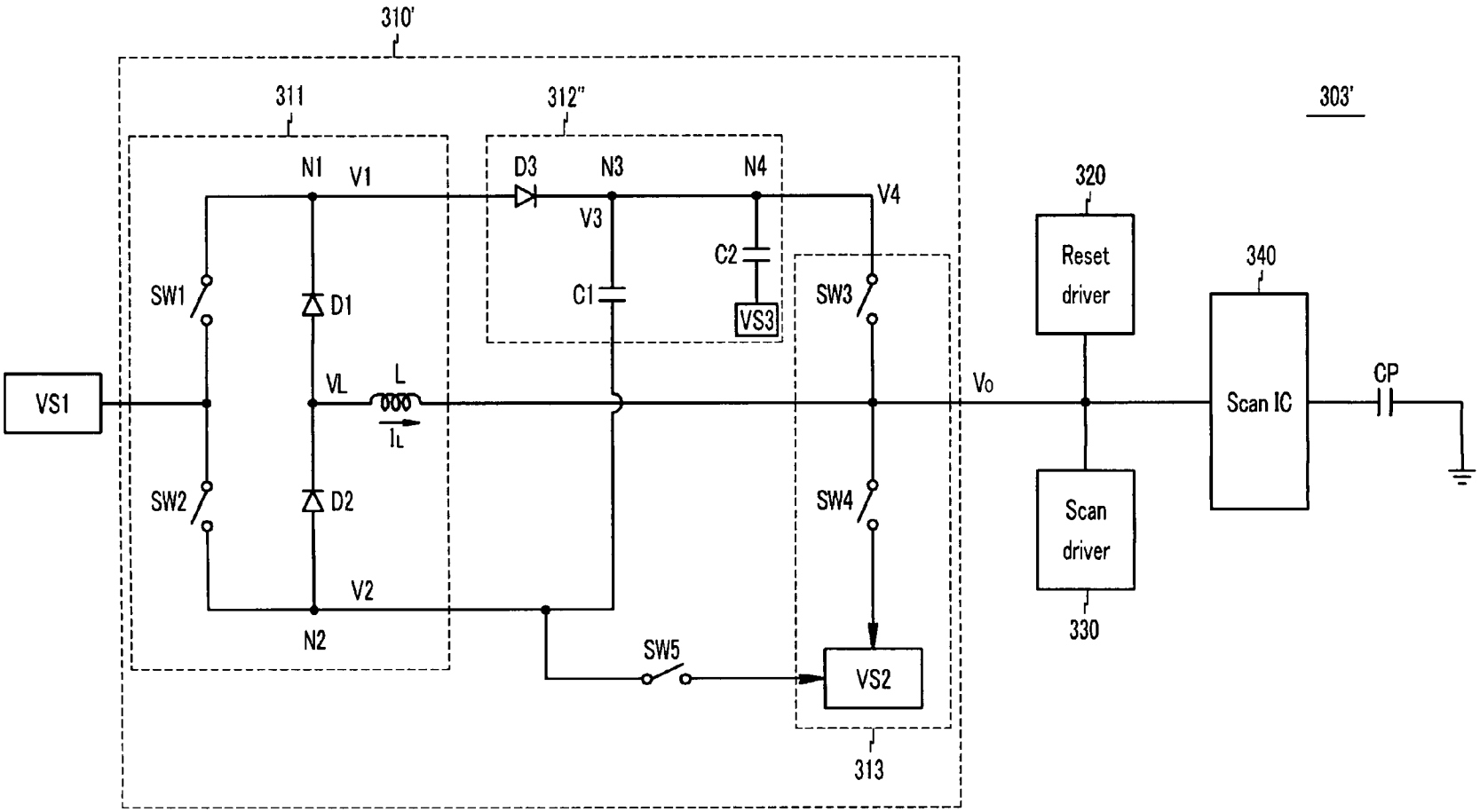
FIG. 7B shows a circuit diagram of the Y electrode driver according to a fourth exemplary embodiment of the present invention.

The voltage storage unit 312" according to the third exemplary embodiment of the present invention further includes a diode D4 having an anode coupled to the third node N3 and a cathode coupled to the switch SW3, and a capacitor C2 having a first terminal coupled to a fourth node N4 that is a node between the diode D4 and the switch SW3, and a second terminal coupled to a third power source VS3 for providing a third voltage (e.g., ground). A fourth exemplary embodiment of FIG. 7B is substantially the same as the third exemplary embodiment of FIG. 7A, except that the diode D4 is not included in a sustain driver 310' of a Y electrode driver 303'.

The voltage V4 at the fourth node N4 is maintained at the voltage Vs because the capacitor C2 is charged with the voltage Vs, and the diode D4 prevents the current from flowing backward from the fourth node N4 to the third node N3 while the switch SW2 is turned on.

In further detail, the switch SW2 is turned on at the time t1, and the voltage V2 at the second node is increased from the voltage −Vs to 0V and the voltage V3 at the third node is increased from 0V to the voltage Vs within the resonance starting time t1'. In this case, the output voltage Vo is not affected by the capacitance component of the switch SW3 because the voltage Vs is stored in the capacitor C2 so that the voltage V4 at the fourth node is maintained at the voltage Vs.

Accordingly, for the period between the time t1 and the time t1', the output voltage Vo is increased by the current flowing through the inductor L because the voltage V2 at the second node is increased to 0V, and as shown in FIG. 8, a voltage Vstart' of the output voltage Vo at the resonance starting point t1' is maintained to be lower, i.e. more negative and closer to −Vs, than the voltage Vstart shown in FIG. 6.

In the second exemplary embodiment of the present invention, because the resonance toward 0V is started at the voltage Vstart' lower than the voltage Vstart, a voltage Vend' at a resonance finishing point is also higher than the voltage Vend shown in FIG. 6. Therefore, the power recovery efficiency is also increased. In addition, because the current for increasing the voltage V2 flows through the switch SW2 for the period between the time t1 and the time t2, the power loss is reduced when the switch SW2 is turned on.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

For example, while the circuit according to the exemplary embodiment of the present invention has been applied to the Y electrode in the first to the third exemplary embodiments of the present invention, it may be applied to the X electrode driver.

According to the exemplary embodiments of the present invention, by using a power source at a voltage −Vs and GND as another power source, power recovery may be performed and the sustain pulse increased to the voltage Vs may be applied.

In addition, power loss of the switch SW2 may be reduced and power recovery efficiency may be increased because the capacitor C2 for maintaining the voltage at the terminal of the switch SW3 to be at a predetermined level is added to the voltage storage unit.

What is claimed is:

1. A plasma display device comprising:

a plurality of electrodes comprising a first electrode;

a first switch having a first terminal electrically coupled to a first power source for supplying a first voltage;

a first diode having a cathode coupled to a second terminal of the first switch;

a second switch having a first terminal electrically coupled to the first power source;

a second diode having an anode coupled to a second terminal of the second switch;

at least one inductor having a first terminal electrically coupled to an anode of the first diode and a cathode of the second diode, and having a second terminal electrically coupled to the first electrode;

a first capacitor having a first terminal coupled to the second terminal of the second switch;

a third switch having a first terminal electrically coupled to a second terminal of the first capacitor, and a second terminal coupled to the first electrode;

a fourth switch having a first terminal coupled to a second power source for supplying a second voltage less than the first voltage, and a second terminal electrically coupled to the first electrode;

a second capacitor having a first terminal coupled to the first terminal of the third switch, and a second terminal coupled to a third power source for supplying a third voltage; and a third diode having an anode coupled to the second terminal of the first switch, and a cathode coupled to the second terminal of the first capacitor.

2. The plasma display device of claim 1, further comprising a fourth diode having a cathode coupled to the first terminal of the second capacitor and an anode coupled to the second terminal of the first capacitor.

3. The plasma display device of claim 1, further comprising a fifth switch having a first terminal electrically coupled to the first terminal of the first capacitor and a second terminal electrically coupled to the second power source.

4. The plasma display device of claim 1, wherein, during a sustain period:

a voltage at the first electrode is increased by turning on the second switch;

a fourth voltage higher than the first voltage is applied to the first electrode by turning on the third switch;

the voltage at the first electrode is reduced by turning on the first switch;

and the second voltage is applied to the first electrode by turning on the fourth switch.

5. The plasma display device of claim 4, wherein a difference between the second voltage and the fourth voltage is double a difference between the first voltage and the second voltage.

6. The plasma display device of claim 1, wherein the third voltage equals the first voltage.

7. The plasma display device of claim 5, wherein the first voltage is a ground voltage.

8. A driver of a plasma display device, the driver for applying a voltage to a plurality of electrodes comprising a first electrode, the driver comprising:

a first switch having a first terminal electrically coupled to a first power source for supplying a first voltage;

a second switch having a first terminal electrically coupled to the first power source;

at least one inductor having a first terminal electrically coupled to the first electrode;

a voltage falling path for reducing a voltage at the first electrode when the first switch is turned on, the voltage falling path being coupled between a second terminal of the first switch and a second terminal of the inductor;

a voltage rising path for increasing the voltage at the first electrode when the second switch is turned on, the voltage rising path being coupled between a second terminal of the second switch and the second terminal of the inductor;

a first capacitor having a first terminal coupled to the second terminal of the second switch;

a third switch having a first terminal electrically coupled to a second terminal of the first capacitor, and a second terminal electrically coupled to the first electrode;

a fourth switch having a first terminal coupled to a second power source for supplying a second voltage less than the first voltage, and a second terminal electrically coupled to the first electrode;

a second capacitor having a first terminal coupled to the first terminal of the third switch, and a second terminal coupled to a third power source for supplying a third voltage; and a charging path for charging the first capacitor, the charging path being formed by electrically coupling the second terminal of the first capacitor to the first power source and electrically coupling the first terminal of the first capacitor to the second power source.

9. The driver of claim 8, wherein:

the voltage falling path comprises a first diode having a cathode coupled to the second terminal of the first switch and an anode coupled to the second terminal of the inductor; and the voltage rising path comprises a second diode having an anode coupled to the second terminal of the second switch and a cathode coupled to the second terminal of the inductor.

10. The driver of claim 8, wherein the charging path comprises a diode having an anode coupled to the first power source and a cathode electrically coupled to the second terminal of the first capacitor.

11. The driver of claim 10, wherein the charging path further comprises a fifth switch having a first terminal electrically coupled to the first terminal of the first capacitor and a second terminal electrically coupled to the second power source.

12. The driver of claim 8, further comprising a diode having a cathode coupled to the first terminal of the second capacitor and an anode coupled to the second terminal of the first capacitor.

13. The driver of claim 8, wherein the third voltage equals the first voltage.

14. The driver of claim 13, wherein the first voltage is a ground voltage.

* * * * *